US007703947B2

(12) United States Patent
Calmes et al.

(10) Patent No.: US 7,703,947 B2
(45) **Date of Patent: *Apr. 27, 2010**

(54) METHOD AND APPARATUS FOR BIDIRECTIONAL CONTROL OF THE COLOR AND DIFFUSION OF A LIGHT BEAM

(75) Inventors: Jack Calmes, Dallas, TX (US); Kevin Stone, Garland, TX (US)

(73) Assignee: Omnicolor, L.P., Dallas, TX (US)

( * ) Notice: Subject to any disclaimer, the term of this patent is extended or adjusted under 35 U.S.C. 154(b) by 258 days.

This patent is subject to a terminal disclaimer.

(21) Appl. No.: 11/593,970

(22) Filed: Nov. 7, 2006

(65) Prior Publication Data

US 2008/0106901 A1 May 8, 2008

(51) Int. Cl.
*F21V 9/00* (2006.01)

(52) U.S. Cl. ..... 362/278; 362/281; 362/284; 362/293

(58) Field of Classification Search ..... 362/278, 362/280, 281, 282, 283, 284, 293, 294, 320, 362/322, 323, 324; 359/889, 891, 892
See application file for complete search history.

(56) References Cited

U.S. PATENT DOCUMENTS 4,697,227 A * 9/1987 Callahan ..... 362/284
4,745,531 A * 5/1988 Leclercq ..... 362/281
5,126,886 A * 6/1992 Richardson et al. ..... 362/283
5,530,571 A * 6/1996 Chen ..... 362/278
6,278,563 B1 * 8/2001 Hewlett ..... 359/889
6,642,969 B2 11/2003 Tew
2006/0268558 A1 * 11/2006 Calmes ..... 362/283

OTHER PUBLICATIONS

Notification of Transmittal of the International Search Report and the Written Opinion of the International Searching Authority, or the Declaration dated Apr. 3, 2008 in connection with PCT Application No. PCT/US07/23343.

* cited by examiner

*Primary Examiner*—Y My Quach Lee

(57) ABSTRACT

A light fixture includes a flexible color filter material coupled to a scrolling mechanism that moves the material in a first direction to position a selected portion of the color filter material in a part of a light beam from the fixture. A device coupled to the mechanism may move the mechanism in a second direction so that another part of the light beam passes unfiltered. Different areas of the color filter material produce different colors. The device may move the mechanism in a direction parallel to a plane of the color filter material. The device may rotate the scrolling mechanism about an axis of rotation substantially parallel to the plane of the color filter material. The color filter material may include a dichroic filter. The light fixture may also include a second scrolling mechanism coupled to flexible diffusion material, such that at least a part of the light beam of the light fixture may be diffused by a predetermined amount.

18 Claims, 4 Drawing Sheets

METHOD AND APPARATUS FOR BIDIRECTIONAL CONTROL OF THE COLOR AND DIFFUSION OF A LIGHT BEAM

TECHNICAL FIELD

The present invention relates to automated lighting equipment, and in particular, to an apparatus, system and method of controlling the color and saturation of a light beam from a light source.

BACKGROUND

The color of a beam of light may be controlled by placing a color filter so that all or part of the beam of light passes through the color filter. Where the color filter is made of a flexible material, color filters of differing colors may be attached to each other side-by-side to create a string of filters. Such a string may be mounted on a motorized scrolling mechanism (a "color filter scroller") that is controlled remotely to position a selected portion of the string in a beam of light.

Where a color filter scroller is used to control the color of a beam of light produced by a lighting fixture, the size of the individual color filters in the string is typically chosen to be slightly larger than the diameter of the light beam. Prior to use of a light fixture, a user may select one or more color filters of desired colors for inclusion in a filter string. Then, the user may operate the color filter scroller during use of the light fixture to position a desired color filter to completely cover the beam of light, causing the light fixture to produce a light beam of the desired color.

In a filter string, a color filter may be placed beside a clear panel of flexible material. Such a filter string may be positioned so that part of the light beam passes through the color filter and the remainder of the light beam passes through the clear panel. The resulting light beam will be a combination of colored and white light. The light beam will be the color of the color filter, but paler, or less saturated, due to the addition of the white light. In this way, the color of the light beam may be controlled prior to use of a light fixture by placing in the color string a color filter of a desired color, and the saturation of the light beam may be controlled during use of the light fixture by the ratio of colored and white light in the beam.

A color filter in a filter string may be placed next to another color filter of a different color. Such a filter string may be positioned so that part of the light beam passes through one color filter and the remainder of the light beam passes through the adjacent color filter. The color of the resulting light beam will be a combination of the two colors. In this way, the color of the light beam may be controlled during use of a light fixture by the ratio of the two colors of light in the beam, and the saturation of the light beam may be controlled prior to use of the light fixture by placing color filters of a desired saturation in the color string.

Accordingly, there is a need for an apparatus, system and method to control both the color and saturation of a light beam during use of a light fixture. Further, there is a need for an apparatus, system and method using flexible color filters to control both the color and saturation of a light beam during use of a light fixture.

SUMMARY

The present invention provides an improved method for controlling both the color and saturation of a light beam during use of a light fixture with flexible color filters. An automated mechanism according to the invention may position a selected ratio of two color filters in a beam of light while allowing a selected amount of the light beam to remain unfiltered.

More specifically, aspects of the invention may be found in a light fixture including a light source and a flexible color filter material coupled to a scrolling mechanism that is capable of moving the flexible material in a first direction to position a selected portion of the color filter material in a first part of a light beam from a light source. Different areas of the color filter material filter the light beam to produce different colors. A device coupled to the scrolling mechanism moves the scrolling mechanism in a second direction so that a second part of the light beam does not pass through the selected portion of the color filter material.

Other aspects of the invention may be found in a method of controlling characteristics of a beam of light. The method includes moving a flexible material with a scrolling mechanism in a first direction. The flexible material is moved to position a selected portion of the material in a first part of the beam of light. The selected portion of the flexible material produces a first predetermined amount of color filtration of the beam of light. The method also includes moving the scrolling mechanism in a second direction that is different from the first direction. This motion positions the flexible material so that a second part of the beam of light does not pass through the selected portion of the material.

Yet other aspects of the invention may be found in an apparatus including a flexible color filter material coupled to a scrolling mechanism that is capable of moving the flexible material in a first direction to position a selected portion of the color filter material in a first part of a light beam from a light source. Different areas of the color filter material filter the light beam to produce different colors. A device coupled to the scrolling mechanism moves the scrolling mechanism in a second direction so that a second part of the light beam does not pass through the selected portion of the color filter material.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the invention. Those skilled in the art should also realize that such equivalent constructions do not depart from the spirit and scope of the invention in its broadest form.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior uses, as well as to future uses, of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, in which.

DETAILED DESCRIPTION

FIGS. 1 through 6, discussed below, and the various embodiments used to describe the principles of the present invention in this patent document are by way of illustration only and should not be construed in any way to limit the scope of the invention. Those skilled in the art will understand that the principles of the invention may be implemented in any suitably arranged wireless communications network.

Figure 1:
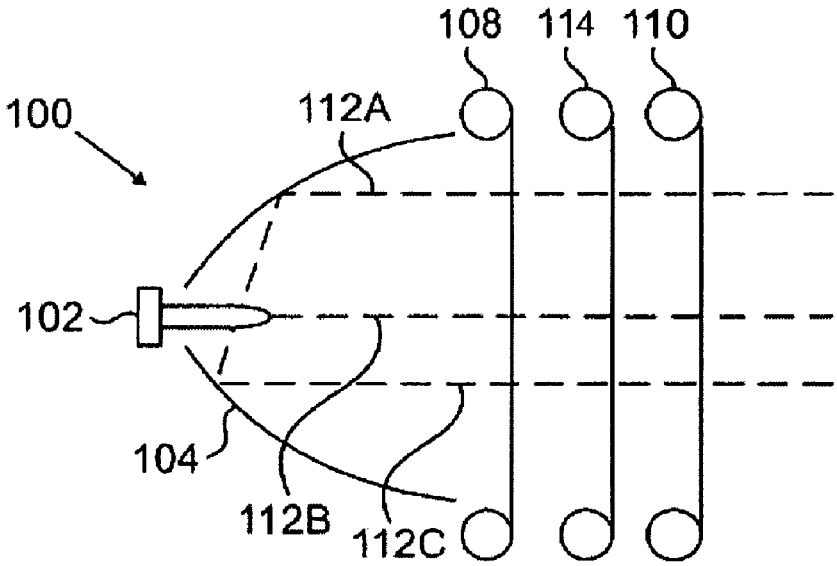
FIG. 1 shows a schematic, cut away side view of an automated lighting fixture in accordance with the invention.

FIG. 1 shows a schematic view of an automated lighting fixture in accordance with the invention. A lamp 102 is mounted near the focal point of a parabolic or near-parabolic reflector 104. Scrolling mechanisms 108, 114 and 110 are mounted across the outlet aperture of the parabolic reflector 104. In this position, the flexible material carried by the scrolling mechanisms 108, 114 and 110 intercepts light rays 112A-C emitted by the bulb 102. The light ray 112A passes directly from the bulb to the mouth of the lighting fixture 100, while the light rays 112B and 112C reflect from the reflector 104 before emitting from the mouth of the lighting fixture 100.

The flexible material carried by the scrolling mechanism 110 may be flexible diffuser material. The flexible material carried by the scrolling mechanisms 108 and 114 may be color filter material. The color filter material may be fabricated as a dichroic filter, which has the benefit that substantially all light at frequencies not passed by the filter are reflected, rather than absorbed. As a result, the filter material stays cooler and requires less frequent replacement. Alternatively, the color filter material may be fabricated from conventional color gels.

While lighting fixture 100 is depicted with a parabolic reflector, it will be understood that a color filter scroller according to the invention may also be used with a light fixture having an elliptical reflector or no reflector at all. Similarly a color filter scroller according to the invention may be used with a light fixture having any type of light source: e.g., LED, filament or arc source. A light fixture according to the invention may be used, for example, in theatrical, concert, motion picture, or architectural lighting applications.

The flexible diffuser material used in scrolling mechanism 110 may be a holographic diffuser, such as LSD® Light Shaping Diffuser Film, manufactured by Physical Optics Corporation of Torrance, Calif. Other flexible diffusion material may additionally or alternatively be used without departing from the spirit and scope of the invention.

While FIG. 1 depicts an embodiment of the present invention having a flexible diffuser material carried by a scrolling mechanism, it will be understood that a light fixture according to the invention may blend the light beam passing through a color filter scroller according to the invention in other ways. In another embodiment of the invention, a glass or acrylic lens may be used, such as a Fresnel lens. Such a lens may be fixedly or removably mounted to the light fixture. Such a removable mounting may permit a user of the light fixture to select a lens providing a desired amount of beam divergence for use with the light fixture.

In yet another embodiment, a single piece of flexible diffusion medium may be mounted in a frame and the frame fixedly or removably mounted to the light fixture. In such an embodiment, removable mounting would again provide the benefit of permitting diffusion material providing a desired degree of diffusion to be mounted to the light fixture.

In still another embodiment of the invention, a light fixture may be designed with an optical system whose effect is to scramble the light rays of the light beam passing through a color filter scroller according to the invention. Such an optical system may blend the colors of the light beam without the need for a flexible diffusion medium or diffusing lens.

Figure 2:
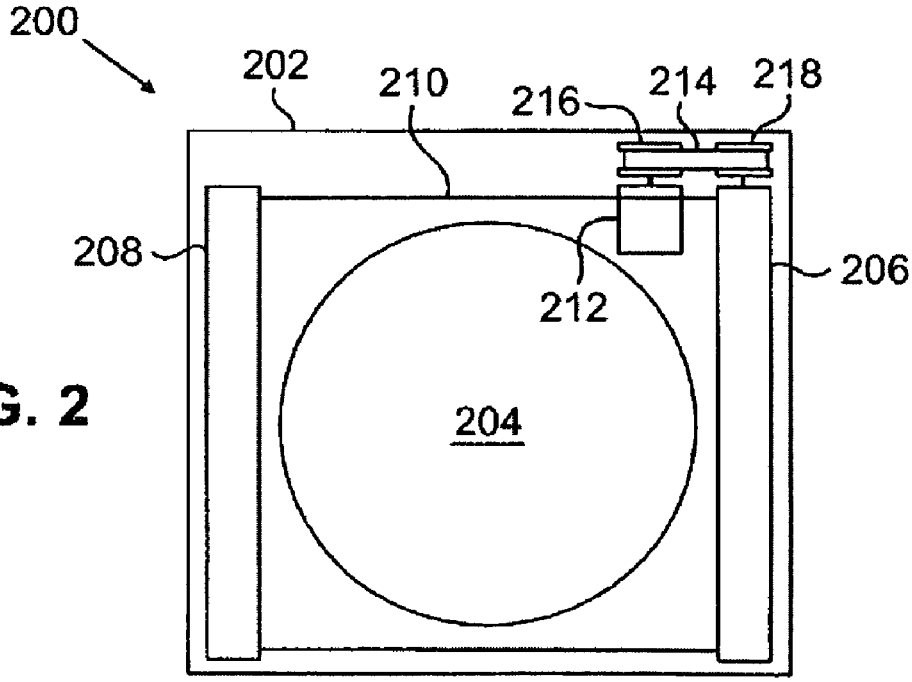
FIG. 2 presents a back view of a scrolling mechanism for use in the light fixture of FIG. 1.

FIG. 2 presents a back view of a scrolling mechanism 200 suitable for use in the light fixture of FIG. 1 as scrolling mechanism 108. A housing 202 may provide mechanical support for components of the scrolling mechanism 108. An aperture 204 in the housing 202 allows a light beam from the light source 102 (including light rays 112A-C) to pass through the housing 202 and a flexible color filter material 210.

The color filter material 210 is wrapped at opposite ends around rollers 206 and 208. A motor 212 drives the roller 206 via a belt 214 and pulleys 216 and 218. The roller 208 may be spring loaded to maintain the color filter material 210 in tension between the rollers 206 and 208. The motor 212 may be remotely controlled by techniques known to the person of skill in the art to wrap or unwrap the color filter material 210 around the roller 206 in order to position a desired portion of the color filter material 210 across the aperture 204 and, thus, across the light beam from light source 102.

Figure 3:
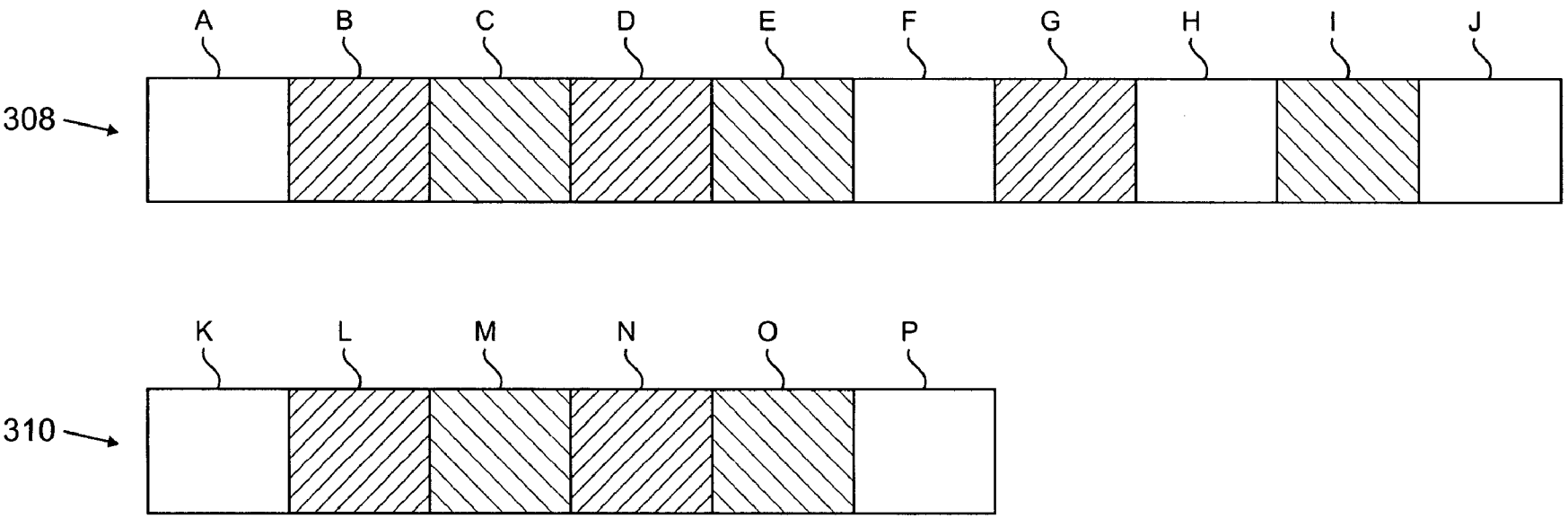
FIG. 3 illustrates color and diffusion strings that may be used in the embodiment of the invention shown in FIG. 1.

FIG. 3 illustrates color filter and diffusion material (or strings) that may be used in the scrolling mechanisms of the lighting fixture 100. Color filter string 308 may be installed in the scrolling mechanism 108. Diffusion string 310 may be installed in the scrolling mechanism 110. In a manner to be described with regard to FIGS. 4A and 4B, the scrolling mechanism 108 may be operated to position a selected portion of the color filter string 308, and the scrolling mechanism 110 may be operated to position a selected portion of the diffusion string 310, across the outlet of the reflector 104, in the light beam from the light source 102 and the reflector 104.

The color filter string 308 is illustrated as having panels A-J. The panels A and J may comprise leader material, used to attach the color filter string 308 to the rollers of the scrolling mechanism 108. The panels F and H may comprise clear material, which does not color the light beam from the light source 102. The panels B-E, G and I may comprise filter material of different colors. The panels B-I may be substantially square, having vertical and horizontal dimensions substantially equal to (or slightly larger than) the diameter of the mouth of the reflector 104.

The color string 308 of FIG. 3 illustrates distinct boundaries between panels that are perpendicular to the sides of the color string. It will be understood, however, that other boundaries between panels may be used without departing from the spirit and scope of the invention. For example, a diagonal boundary or a sawtooth edge to a panel may be employed.

Indeed, the color string 308 may be fabricated without distinct boundaries at all. A gradual transition between an area of color filter and a clear area (or between adjacent areas having different color filters) may, for example, be fabricated as a pattern of disjoint regions of clear material, interspersed with conjoined regions of color filter material. The density of clear regions may increase until, at some point, the regions of clear material become conjoined and the regions of color filter material become disjoint. The density of color filter regions may then decrease until the gradual transition from color filter to clear is complete. It will be understood that other techniques known in the art may be used to produce gradual transitions from colored to clear, or from one color to another color.

Diffusion/pattern string 310 is illustrated as having panels K-P. The panels K and P may comprise leader material, used to attach the diffusion/pattern string 310 to the rollers of the scrolling mechanism 110. The panels L-O may comprise, for example, holographic lens material such as the LSD® Light Shaping Diffuser Film, manufactured by Physical Optics Corporation of Torrance, Calif. The panels L-O may comprise material selected to provide a graduated sequence of increasing omni-directional diffusion, producing round beams of increasing degrees of divergence. In another embodiment of the invention, one or more of panels L-O may comprise material providing differing amounts of divergence in the horizontal and vertical directions, producing rectangular beams of differing degrees of divergence.

Thus, the scrolling mechanism 110 may be operated to position any of the panels L-O across the mouth of the reflector 104. The panels L-O, as described, may act to diffuse the light beam to a predetermined degree of divergence.

As described with regard to the color string 308, the diffusion/pattern string 310 may be fabricated with transitions between panels other than the distinct, perpendicular boundaries shown in FIG. 3. Such gradual transitions or non-perpendicular boundaries may operate to smooth the change from one amount of diffusion to another or from one pattern to another.

Figure 4A:
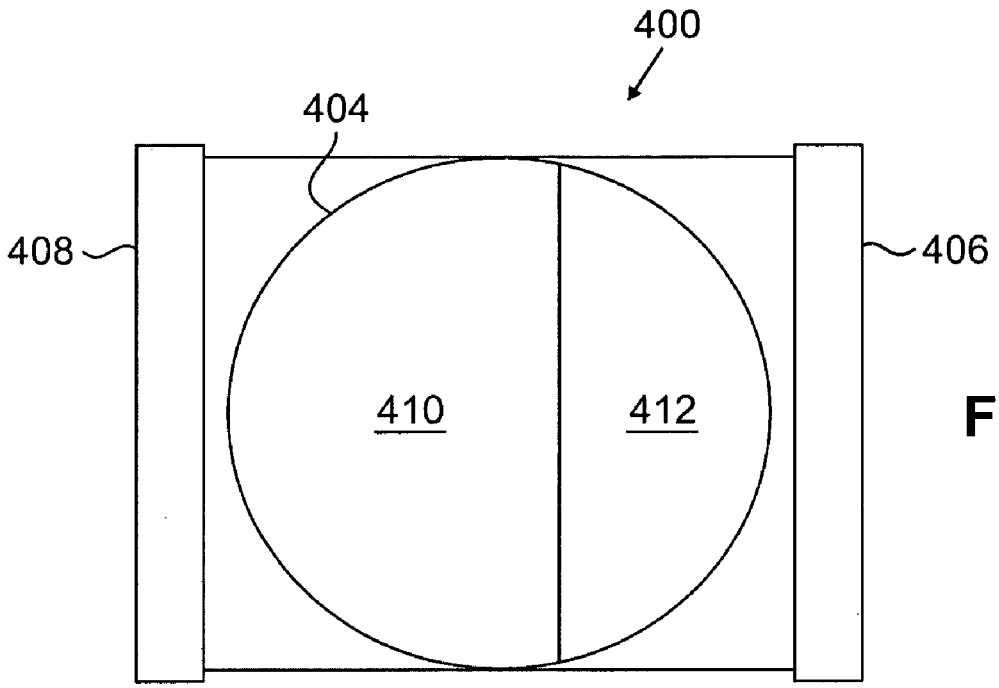
FIGS. 4A and 4B are schematic illustrations of the operation of the embodiment of the invention shown in FIG. 1.

FIG. 4A illustrates the embodiment of the invention shown in FIG. 1 in operation. A scrolling mechanism 400, analogous to scrolling mechanisms 108 and 114 of FIG. 1, may comprise rollers 406 and 408. The scrolling mechanism 400 may operate to position a color string such as the color string 308 shown in FIG. 3 across a mouth 404 of a reflector such as the reflector 104 shown in FIG. 1.

The scrolling mechanism 400 may be operated to position one of the panels of the color string completely across the mouth 404 of the reflector, with the result that the light beam from the reflector is completely colored or uncolored. In the alternative, the scrolling mechanism 400 may be operated to position a desired portion of the color filter string across parts 410 and 412 of the light beam emerging from the mouth 404 of the reflector.

For example, a portion of a colored panel and a portion of an adjacent clear panel may be positioned across the mouth 404 of the reflector. In this way, part of the light beam will be colored and the remainder will remain uncolored. Similarly, the scrolling mechanism 400 may be operated to position a portion of one colored panel and a portion of an adjacent colored panel across the mouth 404 of the reflector. In this way, part of the light beam will have a first color and the remainder will have a second color.

If a diffusion material such as that shown in FIG. 3 is positioned across such a partly colored, or multi-colored, light beam the effect may be to integrate the light beam to a single, blended color. In this way, desired amounts of white and colored light may be blended to produce a light beam having a desired saturation between a pale color and a fully saturated color. Similarly, desired amounts of two colors may be blended in a light beam to produce a light beam having a desired color.

Figure 4B:
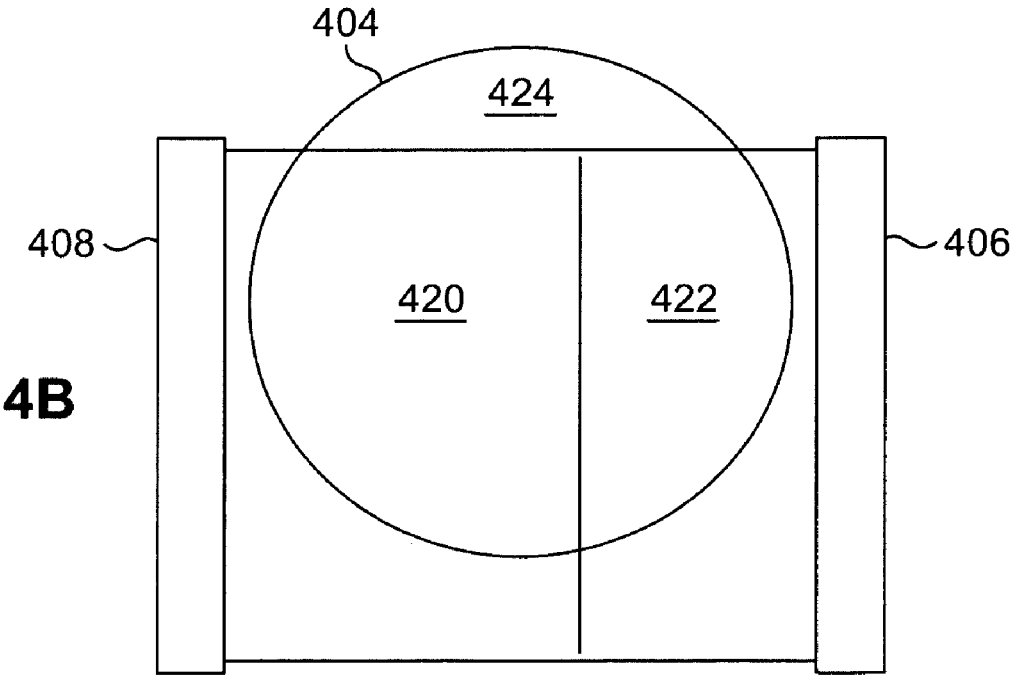

The scrolling mechanism 400 is capable of moving the color filter string in a first direction (horizontally in FIG. 4A) to position a selected portion of the color filter string across the light beam emerging from the mouth 404 of the reflector. As shown in FIG. 4B, the scrolling mechanism 400 may also be capable of moving the color filter string in a second direction (vertically in FIG. 4B) so that a part 424 of the light beam does not pass through the selected portion of the color string. The color string may be moved in the first direction to position a desired amount of a filter of one color across part 420 of the light beam and a corresponding amount of a color filter of another color across part 422 of the light beam. The color string may also be moved in the second direction to leave part 424 of the light beam unfiltered, or white. In this way, the scrolling mechanism may move the color filter string in the first direction to produce a light beam of a desired color and in the second direction to produce a light beam of a desired color saturation.

Figure 5:
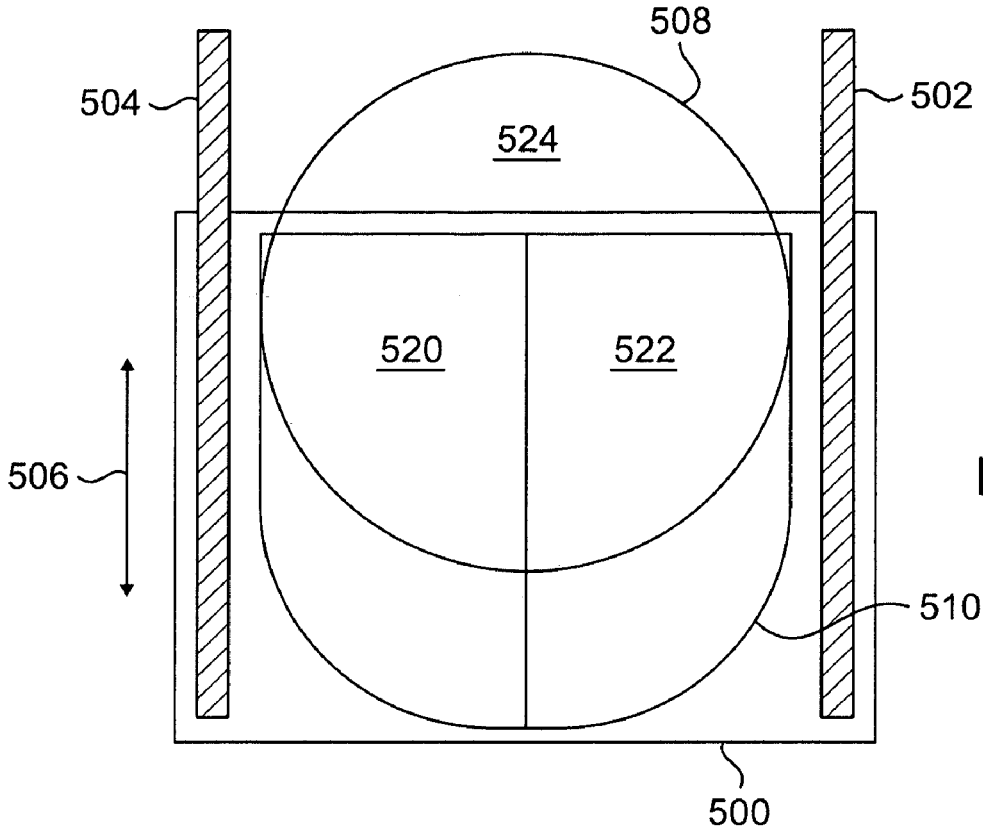
FIG. 5 is a schematic depiction of a device for moving a scrolling mechanism in accordance with the present invention.
Figure 6:
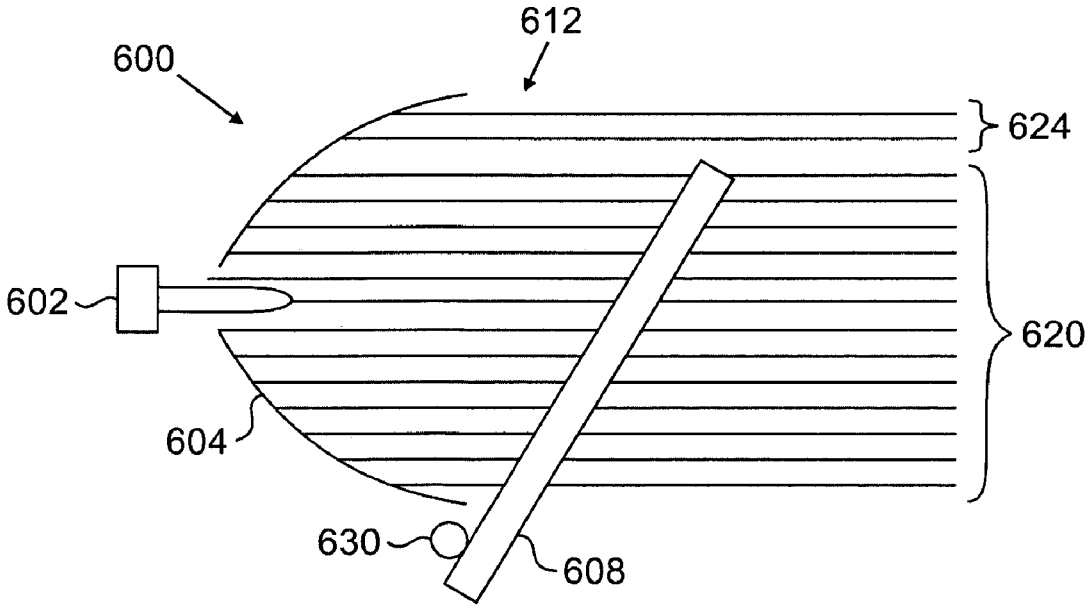
FIG. 6 is a cut-away schematic view of a light fixture in accordance with the invention.

FIGS. 5 and 6 illustrate two embodiments of the present invention having differing devices for moving a scrolling mechanism across a mouth 508 of a reflector in the second direction referred to in the description of FIG. 4B. In FIG. 5 a scrolling mechanism 500 is mounted on rails 502 and 504 to allow motion in a direction indicated by arrow 506. An opening 510 in the scrolling mechanism 500 permits a color string to be moved to position a desired amount of a filter of one color across part 520 of the light beam and a corresponding amount of a color filter of another color across part 522 of the light beam. The scrolling mechanism 500 may be moved along the rails 502 and 504 in the direction 506 to allow part 524 of the beam to pass unfiltered.

In one embodiment of the invention, the scrolling mechanism 500 may be moved in the direction 506 by a cable. In another embodiment, the motion may be produced by a rack-and-pinion mechanism. In yet other embodiments, a solenoid mechanism or a linear actuator may move the scrolling mechanism 500.

FIG. 6 presents a schematic view of another Light fixture 600 embodying the present invention. A lamp 602 may be mounted in a reflector 604 to emit light beam 612. A scrolling mechanism 608 may be pivoted about an axis 630 to position a color string carried by the scrolling mechanism 608 across all or part of the light rays 612. When positioned as shown in FIG. 6, a part 620 of the light beam 612 passes through the color string and a part 624 remains unfiltered.

In one embodiment of the invention, the scrolling mechanism 608 may be moved by a rotary motor attached at the axis 630. In other embodiments of the invention, the pivotal motion of the scrolling mechanism 608 about the axis 630 may be produced by cables or a linear motor.

In another embodiment of the invention, the color filter material in the scrolling mechanism 608 may comprise a dichroic filter material. The color of light transmitted by a dichroic filter is dependent, in part, upon the angle of incidence of the light striking its surface. The tilting motion of the scrolling mechanism 608 both changes the angle of incidence of the light beam 612 on the color filter material and allows the part 624 of the light beam 612 to pass unfiltered. Thus, when a dichroic filter material is used in the scrolling mechanism 608, both the color and saturation of light produced by the light fixture 600.

While the light fixture of FIG. 1 is depicted with one color scrolling mechanism and one diffusion scrolling mechanism, it will be understood that additional scrolling mechanisms may be included in other light fixtures embodying the invention. Furthermore, in other embodiments of the invention, scrolling mechanisms may carry flexible material comprising both color filter material and diffusion material.

While the scrolling mechanisms of the light fixture shown in FIG. 1 has its rollers located on the same sides of the light beam, it will be understood that in other embodiments of the invention one or more scrolling mechanism may be rotated 90 degrees around the longitudinal axis of the light beam. Additionally, in other embodiments the flexible material may be wrapped around the rollers to extend between the sides of the rollers closest to the light source. In this way, the rollers of two scrolling mechanisms might be positioned to lie in the same plane, thereby reducing the length of a light fixture in accordance with the invention.

Although the present invention has been described in detail, those skilled in the art should understand that various changes, substitutions and alterations may be made herein without departing from the spirit and scope of the invention in its broadest form.

What is claimed is:

1. A light fixture, comprising:

a light source;

a flexible material coupled to a scrolling mechanism, the scrolling mechanism operable to move the flexible material in a first direction and to position a selected portion of the flexible material such that a first part of a beam of light from the light source passes through the selected portion of the flexible material, wherein the flexible material comprises first and second areas causing corresponding first and second predetermined amounts of color filtration of the beam of light;

a device coupled to the scrolling mechanism operable to move the scrolling mechanism in a second direction that is different from the first direction and to position the flexible material such that a second part of the beam of light does not pass through the selected portion of the flexible material; and a second flexible material coupled to a second scrolling mechanism, the second scrolling mechanism operable to position a selected portion of the second flexible material such that the beam of light passes through the selected portion of the second flexible material, wherein the second flexible material comprises first and second areas producing corresponding first and second predetermined amounts of diffusion of the beam of light, and wherein the first and second areas of the second flexible material integrate the first part and the second part of the beam of light to produce a blended color.

2. The light fixture of claim 1, further comprising:

a third flexible material coupled to a third scrolling mechanism, the third scrolling mechanism operable to move the flexible material in a third direction and to position a selected portion of the third flexible material such that a third part of the beam of light passes through the selected portion of the third flexible material, wherein the third flexible material comprises first and second areas causing corresponding first and second predetermined amounts of color filtration of the beam of light.

3. The light fixture of claim 2, further comprising:

a second device coupled to the third scrolling mechanism operable to move the third scrolling mechanism in a fourth direction that is different from the third direction and to position the third flexible material such that a fourth part of the beam of light does not pass through the selected portion of the third flexible material.

4. The light fixture of claim 1, wherein a surface of the flexible material is substantially planar and the device moves the scrolling mechanism in a direction substantially parallel to the plane of the surface of the flexible material.

5. The light fixture of claim 1, wherein a surface of the flexible material is substantially planar and the device rotates the scrolling mechanism about an axis of rotation substantially parallel to the plane of the surface of the flexible material.

6. The light fixture of claim 5, wherein one of the first and second areas of the flexible material comprises a dichroic filter.

7. For use in a light fixture, a method of controlling characteristics of a beam of light, comprising:

moving a flexible material with a scrolling mechanism in a first direction to position a selected portion of the flexible material in a first part of the beam of light such that the selected portion of the flexible material produces a first predetermined amount of color filtration of the beam of light;

moving the scrolling mechanism in a second direction that is different from the first direction to position the flexible material such that a second part of the beam of light does not pass through the selected portion of the flexible material;

moving a second flexible material with a second scrolling mechanism to position a first portion of the second flexible material in the beam of light such that the first portion of the second flexible material produces a first predetermined amount of diffusion of the beam of light; and moving the second flexible material with the second scrolling mechanism to position a second portion of the second flexible material in the beam of light such that the second portion of the second flexible material produces a second predetermined amount of diffusion of the beam of light, wherein the first and second portions of the second flexible material integrate the first part and the second part of the beam of light to produce a blended color.

8. The method of claim 7, further comprising moving a third flexible material with a third scrolling mechanism in a third direction to position a selected portion of the third flexible material in a third part of the beam of light such that the selected portion of the third flexible material produces a second predetermined amount of color filtration of the beam of light.

9. The method of claim 8, further comprising moving the third scrolling mechanism in a fourth direction that is different from the third direction to position the third flexible material such that a fourth part of the beam of light does not pass through the selected portion of the third flexible material.

10. The method of claim 8, wherein a surface of the flexible material is substantially planar and moving the scrolling mechanism comprises moving the scrolling mechanism in a direction substantially parallel to the plane of the surface of the flexible material.

11. The method of claim 7, wherein a surface of the flexible material is substantially planar and moving the scrolling mechanism comprises rotating the scrolling mechanism about an axis of rotation substantially parallel to the plane of the surface of the flexible material.

12. The method of claim 11, wherein the selected portion of the flexible material comprises a dichroic filter.

13. An apparatus for controlling characteristics of a beam of light, comprising:

a flexible material coupled to a scrolling mechanism, the scrolling mechanism operable to move the flexible material in a first direction and to position a selected area of the flexible material such that a first part of the beam of light passes through the selected area of the flexible material, wherein the flexible material comprises first and second areas causing corresponding first and second predetermined amounts of color filtration of the beam of light;

a device coupled to the scrolling mechanism operable to move the scrolling mechanism in a second direction that is different from the first direction and to position the flexible material such that a second part of the beam of light does not pass through the selected area of the flexible material; and a second flexible material coupled to a second scrolling mechanism, the second scrolling mechanism operable to position a selected area of the second flexible material such that the beam of light passes through the selected area of the second flexible material, wherein the second flexible material comprises first and second areas producing corresponding first and second predetermined amounts of diffusion of the beam of light, and wherein the first and second areas of the second flexible material integrate the first part and the second part of the beam of light to produce a blended color.

14. The apparatus of claim 13, further comprising:

a third flexible material coupled to a third scrolling mechanism, the third scrolling mechanism operable to move the flexible material in a third direction and to position a selected area of the third flexible material such that a third part of the beam of light passes through the selected area of the third flexible material, wherein the third flexible material comprises first and second areas causing corresponding first and second predetermined amounts of color filtration of the beam of light.

15. The apparatus of claim 14, further comprising a second device coupled to the third scrolling mechanism operable to move the third scrolling mechanism in a fourth direction that is different from the third direction and to position the third flexible material such that a fourth part of the beam of light does not pass through the selected area of the third flexible material.

16. The apparatus of claim 13, wherein a surface of the flexible material is substantially planar and the device moves the scrolling mechanism in a direction substantially parallel to the plane of the surface of the flexible material.

17. The apparatus of claim 13, wherein a surface of the flexible material is substantially planar and the device rotates the scrolling mechanism about an axis of rotation substantially parallel to the plane of the surface of the flexible material.

18. The apparatus of claim 17, wherein one of the first and second areas of the flexible material comprises a dichroic filter.

* * * * *